United States Patent [19]

Joffe

[11] Patent Number: 4,835,891

[45] Date of Patent: Jun. 6, 1989

[54] MOLDED SHEET HOLDING CLAMPS AND FRAMES

[76] Inventor: Edward J. Joffe, 940 Park Ave., Linden, N.J. 07036

[21] Appl. No.: 155,104

[22] Filed: Feb. 11, 1988

[51] Int. Cl.[4] ..... G09F 3/20

[52] U.S. Cl. ..... 40/647; 40/156

[58] Field of Search ..... 40/647, 652, 156; 24/67.7, 67.9, 67.11, 499, 530; 16/225, 227, 277

[56] References Cited

U.S. PATENT DOCUMENTS

| | | | |
|---|---|---|---|
| 2,882,633 | 4/1959 | Howell | 40/647 |
| 3,310,901 | 3/1967 | Sarkisian | 40/647 |
| 4,145,828 | 3/1979 | Hillstrom | 40/647 |
| 4,512,094 | 4/1985 | Seely | 40/647 |

*Primary Examiner*—Gene Mancene
*Assistant Examiner*—Cary E. Stone
*Attorney, Agent, or Firm*—Peter L. Klempay

[57] ABSTRACT

A one-piece, elongated, molded plastic clamp member for forming poster and picture frames or other sheet holders has a base portion, rigid outer, front and inner wall portions connected to a lateral edge of the base portion by a web type hinge, and one or more planar spring portions connected to the base portion and engaging the front and inner wall portions at their juncture to provide overcenter biasing between the closed and open positions of the clamp member. The base portion may be attached to a separate backing panel or may be extended to form the backing panel of a frame.

9 Claims, 3 Drawing Sheets

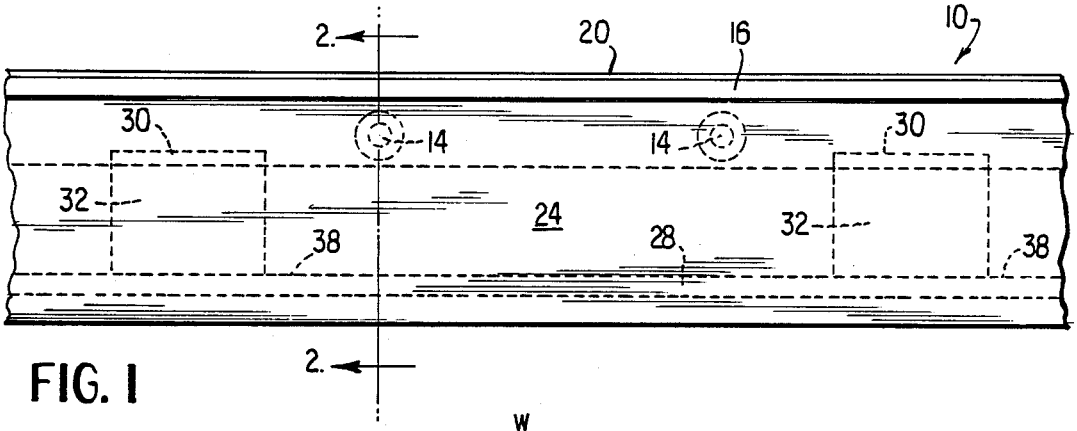
FIG. 1
FIG. 2
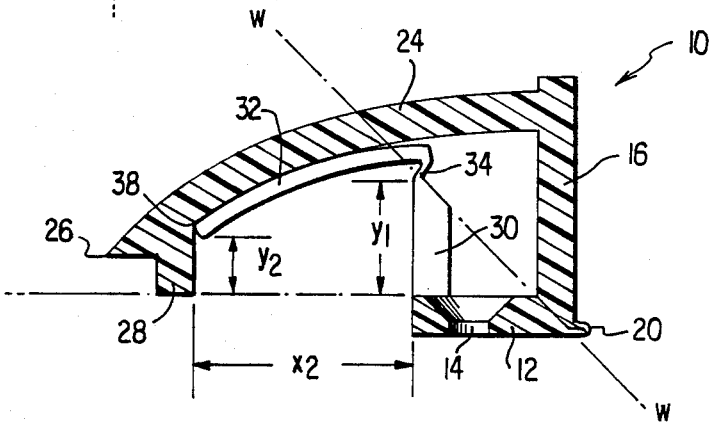
FIG. 3
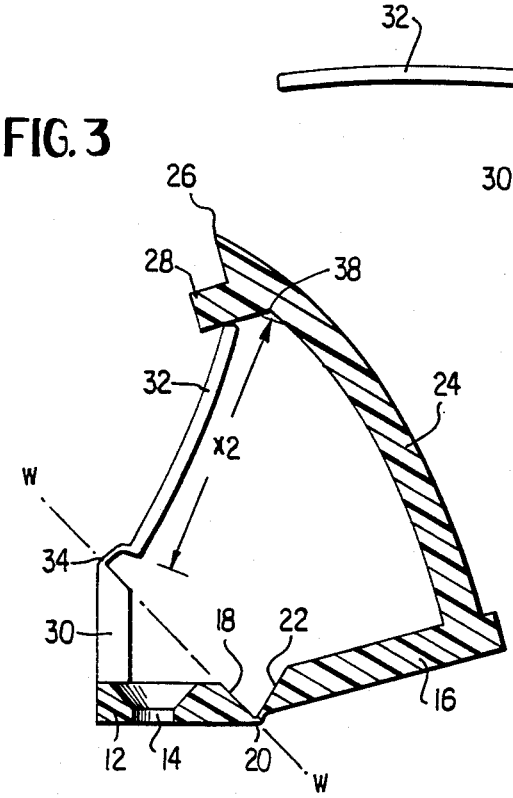
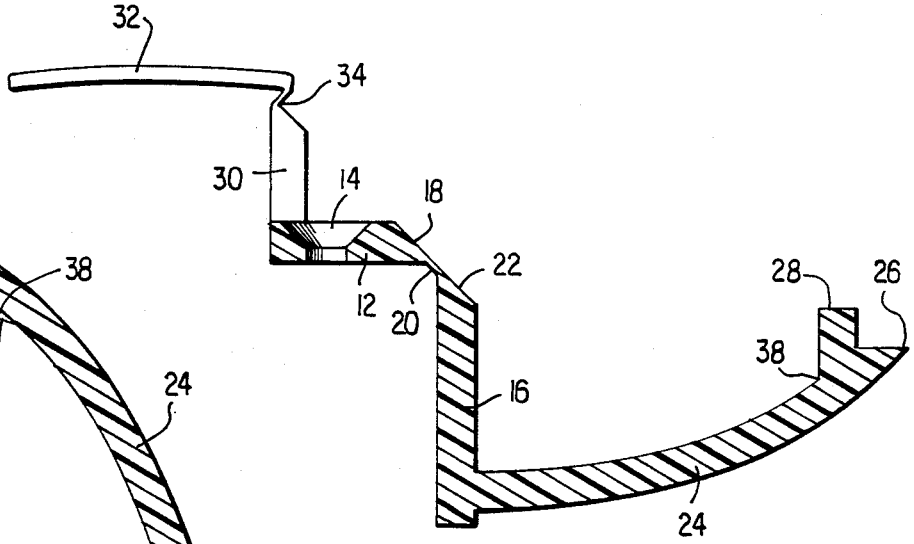
FIG. 4

MOLDED SHEET HOLDING CLAMPS AND FRAMES

The present invention pertains to elongated, molded plastic clamp members and to poster or picture frames and sheet holders incorporating such clamp members.

BACKGROUND OF THE INVENTION

U.S. Pat. Nos. 1,315,196, Moorehous; 2,416,400, Thomas; 2,882,633, Howell; 3,310,901, Sarkisian; and 4,145,828, Hillstrom, disclose picture and poster frames which include elongated metal strips hinged along one edge at the periphery of the frame and biasing springs engaging the strips to hold the same in either an outwardly extending, open position permitting the display material to be inserted into or removed from the frame and a closed position in which the strips clamp the display material along the edges thereof, the strips in the latter position also serving as the face of the frame. Similar frames constructed of extruded plastic strips are disclosed in U.S. Pat. Nos. 4,512,094, Seely, and 4,519,152, Seely et al.

The prior art clamping type frames, as exemplified by the above identified patents, employ relatively complex hinge configurations and biasing spring arrangements. As a result, such frames are expensive to manufacture and may malfunction, particularly after repeated use.

It is the primary object of the present invention to provide an elongated clamp suitable for use in a clamping type frame or other sheet holder which is of single piece construction, suitable for forming by injection molding techniques.

It is a further object of the present invention to provide such an elongated clamp which includes hinge and biasing configurations of simple and reliable design.

It is also an object of the present invention to provide such an elongated clamp member which may readily be provided with a wide range of surface ornamentations, thereby providing a frame or the like of attractive appearance.

SUMMARY OF THE INVENTION

The above and other objects of the invention which will become apparent hereinafter are achieved by the provision of an elongated clamp member of single piece, preferrable injection molded construction, having, in the closed or clamping configuration thereof, a planar base portion; an outer wall portion extending perpendicular to the base portion and connected thereto by a reduced thickness zone forming a hinge; a front wall portion extending from the outer edge of the outer wall portion above the base portion, the front wall portion being inclined downwardly toward the plane of the base portion; an inner wall portion extending from the front wall portion adjacent the free edge thereof in parallel relation to the outer wall; at least one post projecting from the base portion in spaced, parallel relation to the outer wall portion, the post being of lesser height than the outer wall portion; and a spring member connected to the free end of the post by a reduced thickness hinge zone, the spring member projecting forwardly to engage the inner face of the front wall portion at the juncture thereof with the inner wall portion and being of greater length than the distance between the free end of the post and the juncture. When used for poster and relatively large picture frames, posts and spring members are provided at intervals along the length of the clamp. The base member may either be mounted on a panel forming the backing of the frame or, particularly in the case of smaller frames, extend the full area of the frame, forming the backing thereto. In the latter case, a fold out easel and a locking tab therefor may be formed in the backing member.

For a more complete understanding of the invention and the objects and advantages thereof, reference should be had to the accompanying drawings and the following detailed description wherein preferred embodiments of the invention are illustrated and described.

DESCRIPTION OF THE DRAWINGS

In the drawings:

FIG. 1 is an elevational view of a first embodiment of the elongated clamp member of the present invention;

FIG. 2 is a transverse cross sectional view taken on the line 2—2 of FIG. 1;

FIGS. 3 and 4 are transverse cross sectional views corresponding to that of FIG. 2 but showing the clamp member in the open and as-molded orientations, respectively;

DESCRIPTION OF THE PREFERRED EMBODIMENTS

Figure 5:
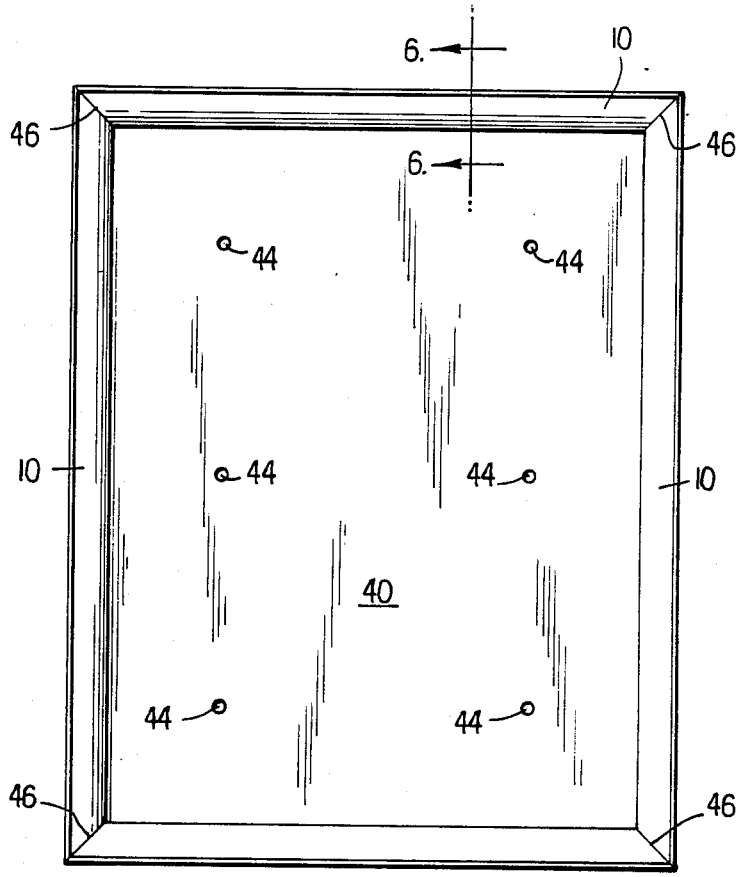
FIG. 5 is an elevational view of a poster frame formed with the clamp members of FIGS. 1–4.

Referring to FIGS. 1 through 4, the first embodiment of the clamp member of the present invention, designated generally by the reference numeral 10, will now be described. The clamp member 10 is an elongated, preferrably injection molded plastic, member having a base portion 12 adapted for attachment to a panel or other support means, the base portion being of planar configuration and may be provided, at spaced intervals therealong, with countersunk through holes 14 for receiving mounting screws. An outer wall portion 16 is connected to the outer lateral edge 18 of the base portion by a web 20 of reduced thickness, the web functioning as a hinge. The lateral edge 18 of the base portion 12 and the lower edge 22 of the outer wall portion 16 are beveled, thus permitting the outer wall portion to be oriented perpendicular to the base portion. A front wall portion 24 extends from the inner face of the outer wall portion 16 adjacent the upper edge thereof. When the clamp member is in the closed or clamping position, as shown in FIG. 2, the front wall portion 24 extends forwardly and downwardly terminating at a forward edge 26 located inwardly of the inner lateral edge of the base portion 12 and above the plane of the upper surface of the base portion. Projecting downwardly from the lower surface of the front wall portion and offset by a short distance from the forward edge 26 thereof is a short inner wall portion 28, the lower edge of which meets the plane of the upper surface of the base portion. The outer wall portion 16, front wall portion 24 and inner wall portion 28 are rigidly interconnected. At intervals, preferrably uniformly spaced, along the length of the base portion 12 posts 30 are provided, the posts projecting upwardly from the base portion at the inner lateral edge thereof. A rectangular member 32 is joined to the upper end of each post by a reduced thickness web 34 functioning as a hinge. The member 32 is of a thickness greater than that of the connecting web 34 but less than that of the rigid wall and base portions of the clamp member so that the member 32 is resilient and functions as a flat spring. The length $x_1$ of the spring member 32 in its relaxed or flat configuration, as shown in FIG. 3, is greater than the distance $x_2$ between the hinge axis of the web 34 and the line of juncture 38 of the inner face of the lower wall portion 28 and the lower face of the front wall portion 24 when the clamp member 10 is in the closed position of FIG. 2. Also, in the closed position, the height $y_1$ of the hinge axis of the web 34 above the plane of the upper surface of the base portion 12 is greater than the height $y_2$ of the line of juncture 38 above this plane.

When the clamp member 10 is closed, the free end of the spring member 32 is in engagement with the inner wall member 28 at the line of juncture 38 and assumes a curved configuration thus exerting a biasing force tending to force the forward edge of the clamp downwardly toward the plane of the base portion 12. Opening of the clamp member is accomplished by lifting the forward edge 26 of the upper wall portion 24, pivoting the upper and outer wall portions about the web hinge 20. As the upper wall portion is lifted, the dimension $y_2$ increases and, once this dimension exceeds that to the plane w—w passing through the axes of the web hinges 20 and 38, which distance is greater than that of $y_1$, the direction of spring bias reverses, to assist in moving the clamp member to the open position.

As will be apparent from a consideration of the as-molded configuration of the clamp member shown in FIG. 4, the member may readily be formed by injection molding techniques, there being no bounded voids or undercut portions to complicate the mold die configurations. Obviously, the clamp members may be formed in any desired lengths.

Figure 6:
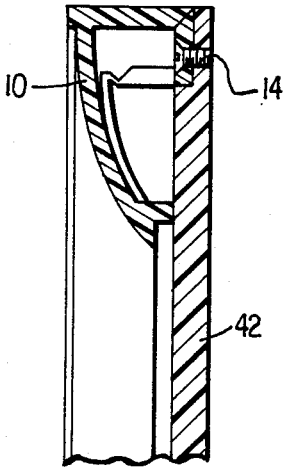
FIG. 6 is a fragmentary cross sectional view taken on the line 6—6 of FIG. 5.

Among the uses of the clamp member 10 are poster and picture frames as shown in FIGS. 5 and 6. Such a frame is formed of four clamp members 10 of suitable lengths mounted along the peripheral edges of a backing member 40, a recess 42 being provided along each edge of the member to receive the base portions 12 of the clamp members with the forward face of the base portion in the same plane as the forward face of the backing member. Any suitable means may be employed for securing the frame to a support surface, for example, the backing member may be provided with holes 44 for mounting screws or bolts. The clamping members 10 are mitered at the corners 46 of the frame.

Figure 7:
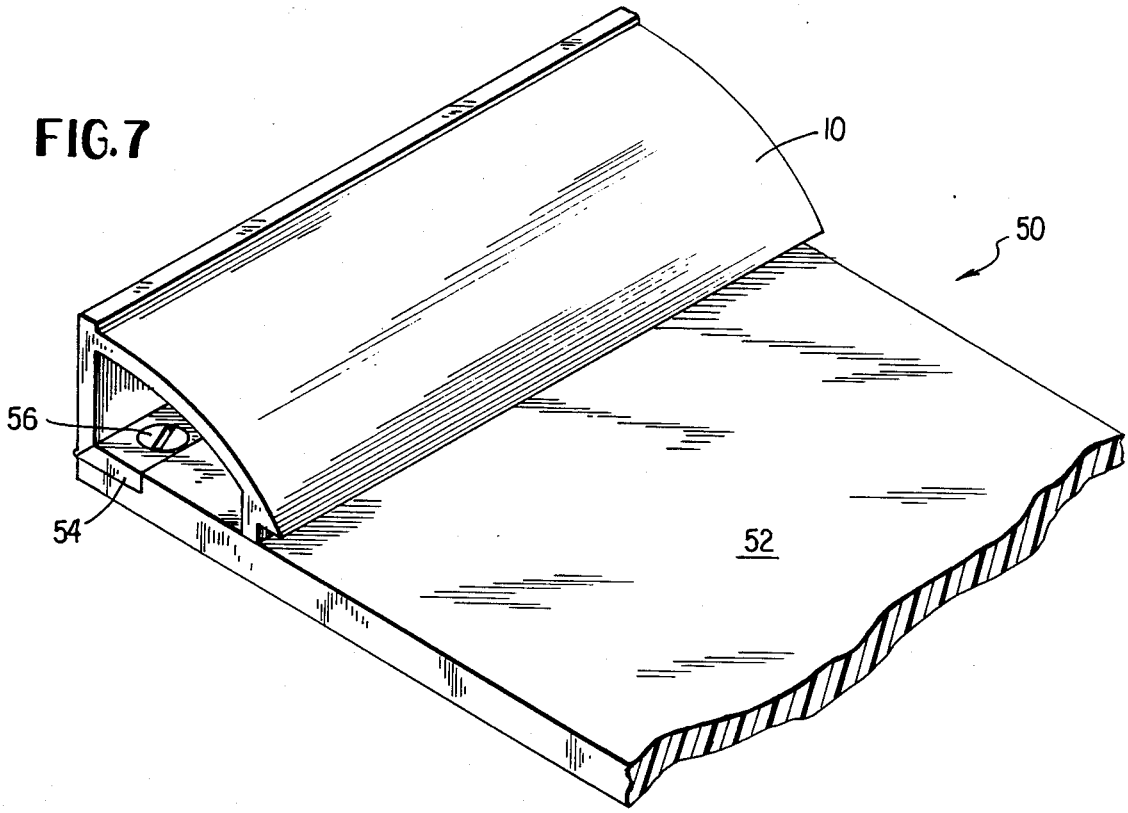
FIG. 7 is a perspective view of a clip board or note holder incorporating the clamp member.

A clip board or note holder 50 is shown in FIG. 7. The board or holder employes a single clamp member 10 attached to a rigid board 52 along one lateral edge thereof. Again, a recess 54 is provided along this lateral edge for reception of the base portion of the clamp member which may be attached thereto with screws 56, for example.

Figure 8:
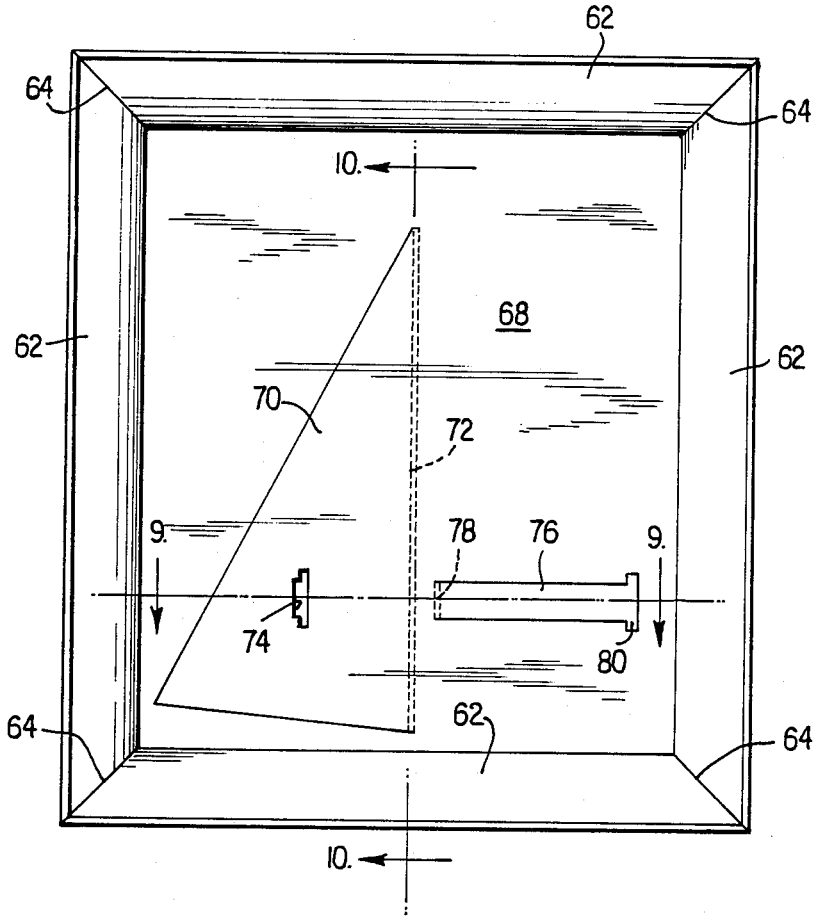
FIG. 8 is an elevational view of a picture frame formed with a second embodiment of the clamp member of the present invention.
Figure 9:
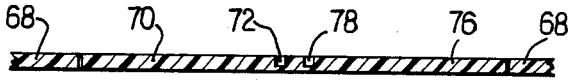
FIG. 9 is a fragmentary cross sectional view taken on the line 9—9 of FIG. 8.
Figure 10:
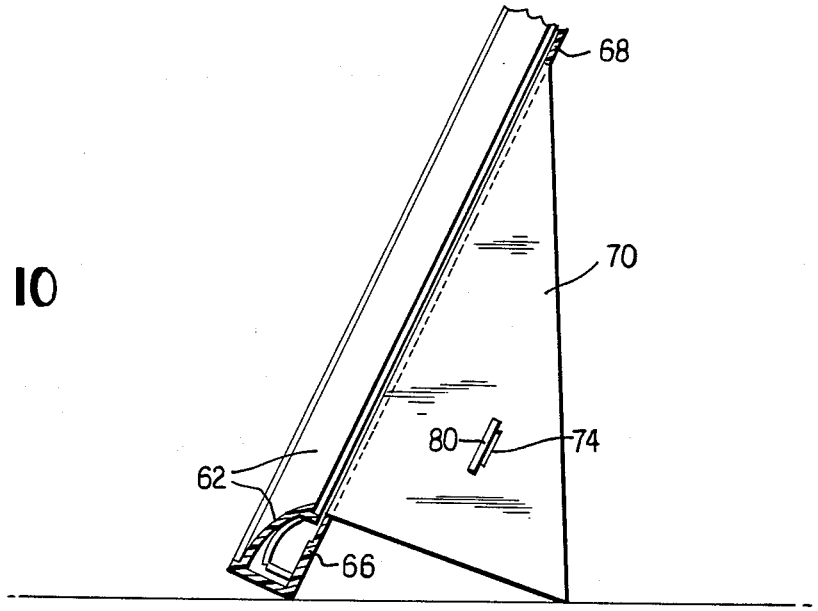
FIG. 10 is a vertical cross sectional view taken on the line 10—10 of FIG. 8.

FIGS. 8, 9 and 10 illustrate a picture frame of the size used on desks, tables and the like. This frame 60 has four clamp members 62 having mitered corners 64 and which, with the exception of the base portion to be described below, are identical to the clamp members 10. In this embodiment, the base portions 66 of the clamp members are formed integrally with the back panel 68 of the frame so that the entire frame constitutes a single unit. The back panel is provided with a triangular section 70 joined along its vertical edge to the panel by a reduced thickness web 72 permitting the triangular section to be pivoted rearwardly to form an easel type support. A T-shaped opening 74 in the section 70 receives a tab 76 also formed in the back panel and connected thereto by a hinge web 78, the free end to the tab being enlarged, as indicated at 80, for locking engagement with the opening 74 when the easel is in the in-use position.

The outer surfaces of the outer wall portion 16 and the front wall portion 24 may be provided with surface ornamentation, if desired. A simulated wood grain finish may be used on these surfaces, for example. Also, while the outer wall portion has been shown as being planar and the front wall portion, as curved, other configurations may be employed.

It will be understood that, while preferred embodiments of the invention have been illustrated and described in detail herein, changes and addition may be had therein and thereto without departing from the spirit of the invention. Reference should, accordingly, be had to the appended claims in determining the true scope of the invention.

I claim:

1. An elongated, molded plastic, one piece clamp member for use with a backing panel to form frames and sheet holders comprising;

an elongated planar base portion adapted for attachment to the backing panel;

outer and front wall portions rigidly connected to one another, said outer wall portion being connected to one lateral edge of said base portion by a web of reduced thickness forming a first hinge, said front wall having a free edge;

an inner wall portion rigidly connected to said front wall portion adjacent the free edge thereof;

at least one post rigidly connected to said base portion adjacent the opposite lateral edge from said hinge, said post having a free end; and a rectangular spring member connected to the free end of said post by a web of reduced thickness forming a second hinge, said spring member being of greater length than the minimum distance between the line of juncture of said front and inner wall portions and said second hinge whereby said spring member exerts a force biasing said front wall portion toward the plane of said base portion when said line of juncture is closer to said plane than a plane containing the axes of said first and second hinges.

2. The clamp member of claim 1 wherein said first hinge connects the base and outer wall portions adjacent the lower and outer faces thereof, respectively, the adjacent edges of said portions being beveled.

3. The clamp member of claim 1 wherein said front wall portion extends beyond said inner wall portion.

4. The clamp member of claim 1 wherein said clamp member is an injection molded plastic member.

5. The clamp member of claim 1 wherein said backing panel is formed as an integral extension of said base portion.

6. A single piece, molded plastic picture frame comprising:

a rectangular backing panel extending the length and width of the frame;

a framing member extending along each lateral edge of said backing panel, each framing member having an outer wall portion connected to said lateral edge by a web of reduced thickness forming a first hinge, a front wall portion projecting rigidly form the outer edge of said outer wall portion and having a free edge, and an inner wall portion projecting rigidly said front wall portion adjacent the free edge thereof;

a plurality of posts rigidly projecting from said backing panel in uniformly spaced relation to said outer wall portion and at spaced intervals therealong, said posts being intermediate said outer and inner wall portions when said framing members are closed against said backing panel, each post having a free end; and for each post, a rectangular spring member connected to the free end thereof by a web of reduced thickness forming a second hinge, said spring member being of greater length than the minimum distance between the line of juncture of said front and inner wall portions and said second hinge whereby said spring member exerts a force biasing said front wall portion toward said backing panel when said line of juncture is closer to said backing panel than the plane containing the axes of said first and second hinges.

7. The picture frame of claim 6 wherein said backing panel includes a triangular section connected along one of its sides to said panel by a reduced thickness web type hinge and a tab section adapted to engage said triangular section and hold the same in rearwardly projecting relation to said panel to provide an easel type support for said frame.

8. The picture frame of claim 7 wherein said frame is an injection molded plastic frame.

9. The picture frame of claim 6 wherein said frame is an injected molded plastic frame.

* * * * *